United States Patent [19]

Wooten et al.

[11] Patent Number: 4,607,253

[45] Date of Patent: Aug. 19, 1986

[54] DOOR GUARD WITH ALARM DEVICE

[76] Inventors: Richard Wooten, 4251 Warwick, Anchorage, Ak. 99508; Larry Wooten, deceased, late of Anchorage, Ak.; by Carol J. Wooten, legal representative, 4251 Warwick, Anchorage, Ak. 99508

[21] Appl. No.: 677,369

[22] Filed: Dec. 3, 1984

[51] Int. Cl.[4] ..... G08B 13/08

[52] U.S. Cl. ..... 340/546; 200/61.93; 292/339; 340/545

[58] Field of Search ..... 340/546, 545; 292/339, 292/338; 200/61.93, 61.62

[56] References Cited

U.S. PATENT DOCUMENTS

| | | | |
|---|---|---|---|
| 4,358,758 | 11/1982 | Morton | 340/546 |
| 4,442,427 | 4/1984 | Morton | 340/546 |
| 4,483,558 | 11/1984 | Van Meter | 292/339 |

*Primary Examiner*—Glen R. Swann, III

*Attorney, Agent, or Firm*—Michael J. Tavella

[57] ABSTRACT

A combination door lock and alarm consists of an adjustable shaft, two pads which are able to pivot, and an automatic alarm. The pads are provided with non-skid surfaces which ensure the stability of the device. The pivot feature of the pads allows quick set-up of the device without the need of extensive adjustment. A novel alarm actuating means is also disclosed, which consists of a spring clip in contact with a toggle switch. The use of the toggle switch allows for a continuous alarm signal, even after pressure is removed from the device. The alarm actuating means is activated by a spring loaded shaft, which will be pushed into the main shaft of the device as pressure is applied to the door. The spring clip is mounted on the outside of the spring loaded shaft and the movement of this shaft is what forces the clip to trip the toggle switch. The unit is designed to fit conveniently into a suitcase for travel and can be suspended from a door knob when not in use.

10 Claims, 6 Drawing Figures

DOOR GUARD WITH ALARM DEVICE

BACKGROUND OF THE INVENTION

This invention relates to door securing devices, and more particularly to door securing devices of the bracing type, with alarms.

With the rise in violent crimes in the United States, there is a wide spread fear among people related to their sense of security in the home and perhaps even more important, when traveling. People staying in hotels and motels often find themselves staying in a room protected only by an inexpensive lock. Many devices have been developed to provide a greater degree of protection by providing some type of portable supplemental locking devices. These devices generally fall into three main types: the portable door lock that operates with a key, as a second lock in the door; a alarm device that does not impede the operation of the door, but sounds an alarm when disturbed; and the door brace type that is mounted between the door and the floor, which then acts as a brace. The door brace can also be fitted with an alarm.

One example of the auxillary door lock is found in U.S. Pat. No. 4,059,299 to Huntly. This device is installed in the door jamb and is key operated. While this device is an effective deterrent, it is somewhat difficult to set up. Of course, if the lock is installed improperly, it will most likely fail or be difficult to remove. Also, while it is designed to fit many types of doors, it is possible that it may not fit all doors.

The second type of device is illustrated in U.S. Pat. No. 4,264,899 to Menzies, et al. This device is simply a small alarm unit that is placed against the door. If the door is moved, the device pivots and the alarm is set off. This device has the advantage of not preventing entry by emergency personnal. However, it does not prevent access by unauthorized personnel, thus, while this type of alarm is a deterrent, it will not prevent entry.

The third type of device is the most common. Several examples of this device are found in the literature. For example, U.S. Pat. No. 2,870,281 to Mitchell describes a device that is mounted on the door knob. The device is then set against the floor to prevent the door from opening. The device is provided with a pointed end that is used to keep the device from slipping when in use. The device is fitted with an alarm that will sound if the door is moved in either direction. U.S. Pat. No. 3,583,743 to Newell shows another type of brace. This device consists of a modified bumper jack. The device has a collar that fits under the door knob. It also has a small skid-proof plate mounted on the bottom to prevent slippage. The device is "jacked" into position against the door. Two other very similar devices are found in U.S Pat. Nos. 4,358,758 and 4,442,427 both to Morton. The Morton devices consist of a telescoping rod that is placed between the door knob and the floor. The bottom of the rod is fitted with a skid-proof cap. The devices use two different switching schemes for the alarms. The first patent uses a simple contact switch that is mounted at the top of the rod and placed against the door. The second device has a small alarm box with a push plunger type switch. To set this alarm, the alarm box is slid up the tube until it makes contact with the door.

All of these devices in the last catagory have one major problem: they all utilize the knob as the support point on the door. The knob is, in many cases, very weak compared to the door itself. Further, it is not designed to carry heavy loads. It is possible that the knob could fail to hold.

Many of the devices also use either small pads or no pads at all to make contact with the floor. This lack of surface contact can lead to insufficient holding strength when needed. The small pad shown in Morten can give way under repeated attempts to open the door by pushing and pulling in a rocking motion. Under this type of action, the small contact surface is insufficient to hold. It also requires the user to make sure of proper placement of the device. Otherwise, it is possible that the device will not hold at all.

The alarm device in Morton has additional problems in that it must be positioned against the door. This requires a balancing act by the user in setting the device firmly against the floor to prevent slippage, while at the same time, ensuring that the alarm switch is set properly against the door. The present invention overcomes all of these difficulties.

BRIEF DESCRIPTION OF THE INVENTION

The present invention consists of an adjustible length shaft assembly that forms the main brace means. Two non-skid pads are mounted to the shaft (one at each end of the shaft). These pads provide a large surface to contact the door and the floor surface to prevent slipping. One distinct feature of this device is that it does not rely on the door knob for support. In fact, this device could be used on doors that have no knobs at all. The device uses the non-skid pad to create enough frictional force against the door to hold it in place. Both pads are provided with pivots to allow proper set up of the device quickly and efficiently. Because of the flexibility of the pads, setting the device does not require careful positioning. The device is fitted with an alarm system.

DESCRIPTION OF THE PREFERRED EMBODIMENT

Figure 1:
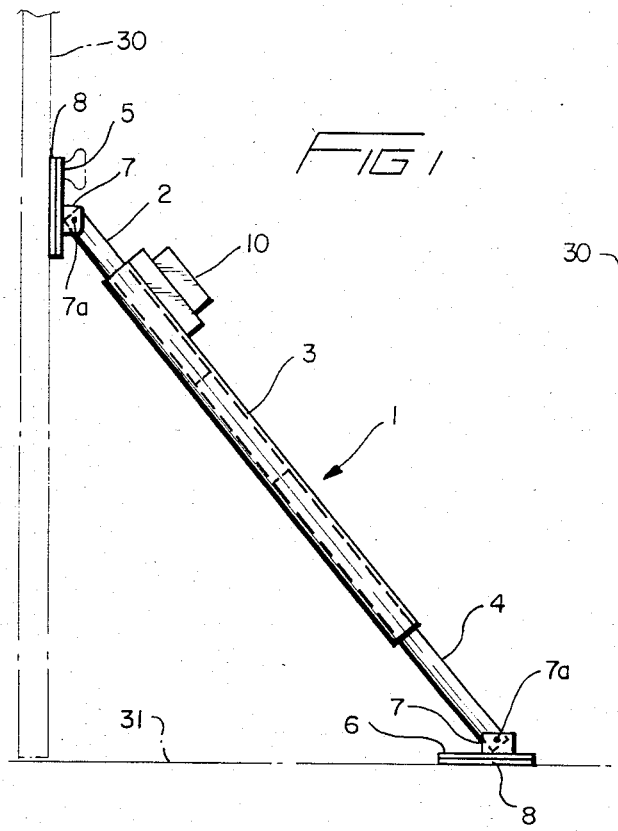
FIG. 1 is a perspective view of the device in place for use.

Referring now to the drawing figures, and more particularly to FIG. 1, the invention comprises an adjustible shaft 1 comprising three distinct parts; a top shaft portion 2, a middle shaft portion 3 and a bottom shaft portion 4, which are slidibly engaged. Both the top shaft portion 2 and the bottom shaft portion 4 are sized to slide into the middle shaft portion 3. The middle shaft portion 3 and the bottom shaft portion 4 make up the adjustible portion of the shaft 1. The top shaft portion 2 contains the alarm actuating means, which will be further discussed below. Adjustment and locking means for the shaft 1 will be discussed in further detail below as well.

A top pad 5 is attached to the top shaft portion 2 and a bottom pad 6 is attached to the bottom shaft portion 4. The pads 5 and 6 are supplied with brackets 7 into which the shaft parts 2 or 4 are placed. Both pads are connected to the shafts by pivot means *7a*. The preferred pivot means are high strength rivets, although bolts and nuts and other common fasteners can be also used. The pivot means are used to secure the shaft parts to the pads. The brackets 7 can be punched out of the pad itself, or can be riveted or welded to the pad.

The brackets 7 must be offset from the center of the pads 5 and 6. This offset transfers the load to the pad at an optimum angle, thereby increasing the strength of the device as well as decreasing the possibility of moving the device when in use. In the preferred embodiment, the pads 5 and 6 are typically 4 inches wide by 5 inches long. The pivot pin *7a* location is centered $1\frac{3}{4}$ inches from the unnotched end 40 of the top plate 5. The pivot pin on the bottom plate 6 is centered 2 inches from the end 41 of the bottom plate 6. Of course, pads of different sizes can be substituted with the resulting adjustments in dimentions.

Both pads 5 and 6 have a non-skid portion 8 fixedly attached to the pad as shown. The non-skid portion 8 is typically a non-skid type rubber or similar material common in the art. The non-skid portion 8 can be glued to the pad or fastened by other common means known in the art.

The top pad 5 has a notched portion cut in at the top of the pad (as shown in the drawing FIG. 2) to allow it to fit under a door knob.

Normally, when not in use, the device is hung from the knob 33 by an elastic cord 9. The cord 9 is typically looped and the open ends are then wired together, thereby forming a continuous loop of cord. Any other suitable method for fastening the ends of the cord loop can be used as well, including clips that are common in the art. The wired ends are then placed inside the top shaft portion 2 and are held in place by the top pivot means *7a*, which is passed through the loop. Stored in this manner, the device is ready to use in a matter of seconds.

An alarm device 10 is attached to the middle shaft portion 3 by rivets or other means. The alarm device 10 is designed to produce a loud, piercing sound. The alarm 10 is provided with a toggle switch 11 that will activate and maintain the alarm when the door is pushed (see FIG. 3). The toggle switch is designed to activate the alarm 10 and also provide a means of disengaging the alarm 10 after it has been set off; it also ensures that the alarm can only be activated or deactivated by someone inside the room.

Figure 3:
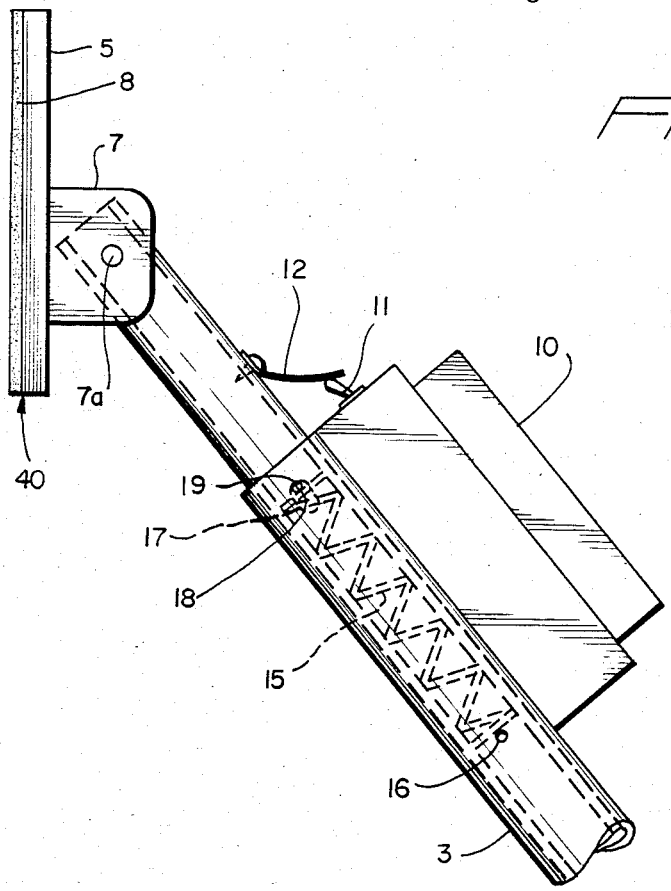
FIG. 3 is a detail view of the pivot connection of the top pad assembly and the alarm actuating means.
Figure 4:
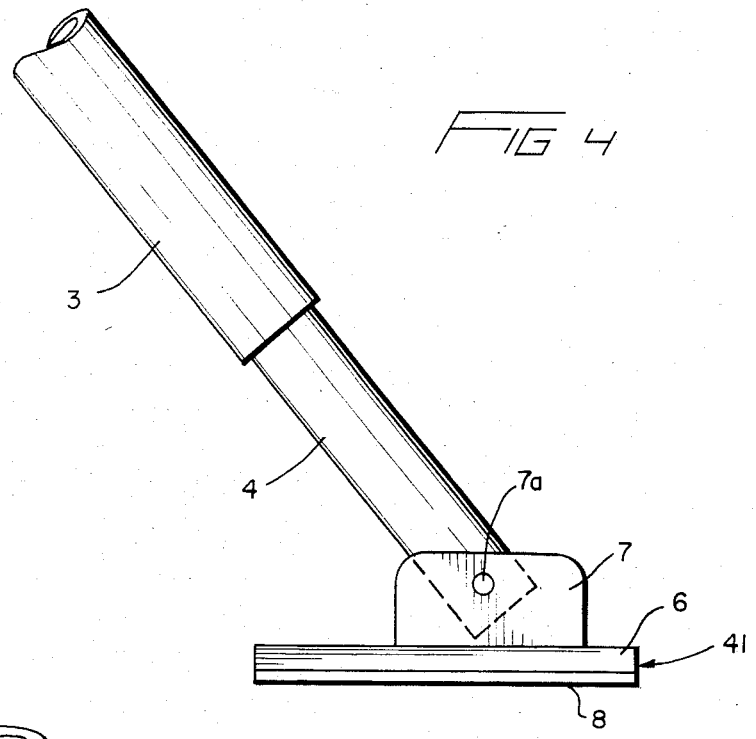
FIG. 4 is a detail view of the pivot connection of the bottom pad assembly.

A spring clip 12 is fastened to the top shaft portion 2 by rivets or screws as shown. The spring clip 12 is positioned above the toggle switch 11 so that as pressure is put on the door, and the device is forced back, the spring clip 12 will trip the toggle switch 11 and set off the alarm 10. The alarm actuator, which will force the spring clip 12 into tripping the toggle switch 11, consists of a spring mechanism mounted in the top shaft portion 2. Referring now to FIG. 3, the spring mechanism comprises a coil spring 15 which is displaced inside the top shaft portion 2. A retainer pin 16 is disposed inside of the middle shaft portion 3. The retainer pin 16 is used to keep the spring from falling through the shaft portion once the device is assembled. It is also used to compress the spring 15 when the shafts are assembled, which produces a force on the top shaft portion 2. A slot 17 is provided in the top shaft portion (as shown in the figure). In the preferred embodiment, the slot 17 is actually a $\frac{1}{4}''$ hole; however, the slot is not limited to only a hole. The slot 17 is located such that when the top shaft portion 2 is pushed into the middle shaft portion 3, it aligns with a retaining hole 18 in the middle shaft 3. A pin 19 is then pushed through the entire shaft assembly, at hole 18, to hold the top shaft portion 2, which is now under spring tension, inside the middle shaft portion 3. In the preferred embodiment, the pin 19 is $\frac{1}{8}$ inch in diameter.

Because the slot 17 is larger than the retaining pin 19, there is a small amount of movement or play in the shaft 2. As the door is pushed open, the top shaft portion 2 will be pushed further into the middle shaft portion 3 until the spring clip 12 forces the toggle switch 11 to activate the alarm 10. The size of the slot 17 will determine the amount of travel of the top shaft portion 2. It is best to keep this amount of travel to a minimum, as it will allow the alarm to sound with only a minor door movement. In the preferred embodiment, the spring clip 12 is designed to trip the switch 11 within a very small range of movement (the door should move less than an inch).

Figure 5:
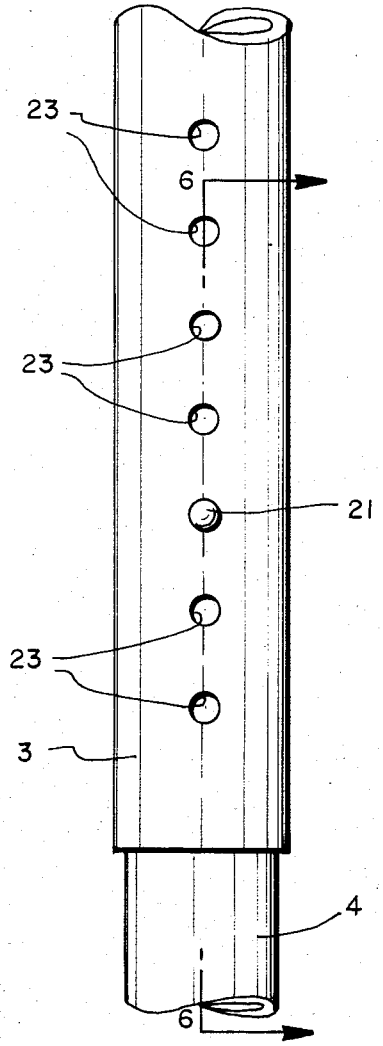
FIG. 5 is a front view of the adjustible length shaft.
Figure 6:
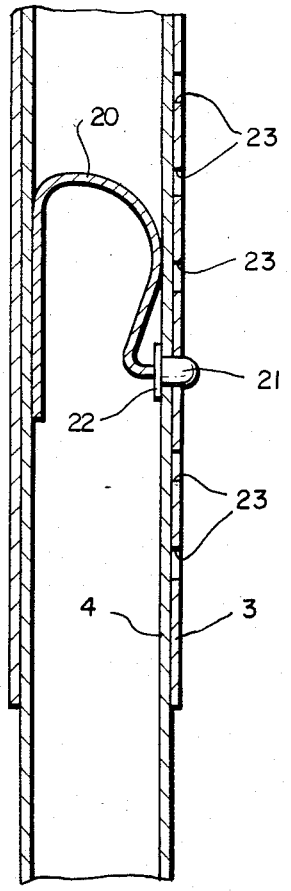
FIG. 6 is a cross sectional view taken along the section lines 6—6 of FIG. 5 showing the engaging and locking element of the adjustible length shaft.

Referring now to FIGS. 5 and 6, the length of shaft 1 is adjusted by a spring clip locking mechanism. The mechanism consists of an arched spring clip 20 which is fastened to the inside surface of the bottom shaft portion 4. The spring clip 20 is held in place in the shaft portion by its own tension. A plunger end 21 is attached to the end of the spring clip 20. An exit hole (not shown) is provided in wall of the bottom shaft portion 4 which allows the plunger end 21 to protrude through the wall of the bottom shaft 4. Several alignment holes 23 are provided in the middle shaft portion 3. These alignment holes are regularly spaced along the front portion of the shaft 3 (see FIG. 5). The plunger end 21 is designed to fit in the alignment holes 23. In use, the plunger end 21 is pushed into the bottom shaft portion 4 through hole 23. The middle shaft portion 3 is then moved to the position of the desired alignment hole 23. The plunger end, which is retained inside the wall when the shaft is being adjusted, then exits from the new hole location, locking the two shafts in place. The plunger end 21 has a flange portion 22 as shown, which holds the plunger end 21 in place against the exit hole (not shown) in the wall of shaft 4.

For travel, the device can be broken down into two pieces for packing in a suit case. To pack the device, the spring clip 20 is pushed into the bottom shaft portion 4 and the bottom shaft portion 4 is then pulled completely out of the middle shaft portion 3. The two pieces will now be the proper size to fit in a suitcase (typically less than 30 inches). In the preferred embodiment, the device can be broken down into a bottom section which is $22\frac{1}{2}$ inches long, and a top section which is 27 inches long. The device is reassembled by sliding the bottom shaft portion 4 into the middle shaft portion 3 until the button portion 21 protrudes from one of the alignment holes 23. The device can then be adjusted and used in the normal manner.

Figure 2:
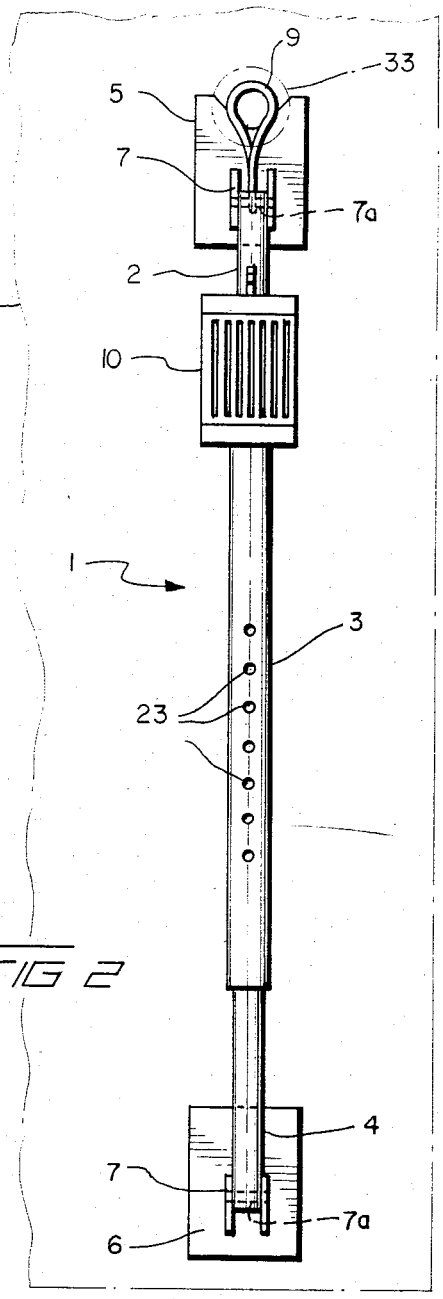
FIG. 2 is a perspective view of the device as folded for storage.

As shown in FIG. 2, the device is normally suspended from a door knob 33 by the elastic shock cord 9 when it is not in use. Referring now to FIG. 1, when the device is needed, the user positions the top pad 5 of the device against a door 30, with the cut portion resting against the bottom of the knob 33. The shaft is then extended until the device contacts the floor 31 and the device is at a stable angle. Once the shaft has been locked into place, the device is ready for use. There is no need to adjust the alarm or make sure it is properly positioned. The large pads ensure firm contact with the door and any floor surface. The alarm actuating mechanism eliminates the need to position the alarm for correct operation. Alarm operation is automatic.

The device an also be used on doors that have no knobs, or doors that have unusual latches instead of knobs. In these cases, the device is simply positioned against the door, without regard to the position of the latch, and then extended and securred against the floor.

It is intended that the present disclosure should not be construed in any limited sense other than that limited by the scope of the following claims having regard to the teachings herein and the prior art being apparent with the preferred form necessary for the better understanding of the invention and may be subject to modification by skilled persons within the scope of the invention without departing from the concept thereof.

I claim:

1. A door securing and alarm device for portable use and ready installation comprising:

A. An adjustable length shaft portion, having an upper end and a lower end;

B. A first non-skid pad, said pad having a generally rectangular shape and having a relativly flat surface contact area which is large relative to the diameter of the shaft, said pad being pivotably mounted on the upper end of said shaft portion;

C. A second non-skid pad, also having a generally rectangular shape and having a relativly flat surface contact area which is large relative to the diameter of the shaft, said second pad being pivotably mounted on the lower end of said shaft portion;

D. An alarm device fixedly mounted to said shaft portion;

E. Actuating means, mounted on said shaft portion, providing means for actuating the alarm, said actuating means being responsive to a limited movement of the door inwardly.

2. The device of claim 1 wherein the adjustable length shaft portion includes inner and outer telescoping sleeve portions and a plunger adjustably registerable with one of a plurality of holes longitudinally arranged in said tubes.

3. The device of claim 1 wherein the said actuating means comprise a spring clip, fixedly attached to the upper end of said adjustable length shaft portion, in contact with a toggle switch, which is fixedly mounted to said alarm device such that when the device is subjected to pressure force from a door, said spring clip will exert a force on said toggle switch thereby activating said alarm device.

4. The device of claim 1 wherein a cord loop is included attached to the upper end of said shaft to allow it to be stored in an inactive position by suspending the device from the door knob by the cord loop.

5. The device as claimed in claim 1 wherein said alarm device is of an electrically operable, audible type having its own power supply included.

6. The device of claim 5 wherein the said actuating means comprise a spring clip, fixedly attached to the upper end of said adjustable length shaft portion, in contact with a toggle switch, fixedly mounted to said alarm device such that when the device is subjected to pressure force from a door, said spring clip will exert a force on said toggle switch thereby activating said alarm device.

7. A door securing and alarm device for portable use and ready installation having an adjustable length shaft comprising:

A. A lower shaft portion;

B. A middle shaft portion having an upper end and a lower end, the lower shaft portion being slidably connected to the lower end of the middle shaft portion;

C. An upper shaft portion which is slidably connected to the upper end of the middle shaft portion, said combination of said shaft portions forming the adjustable length shaft;

D. Means of adjusting the length of the adjustable length shaft;

E. A first non-skid pad, said pad having a generally rectangular shape and having a flat surface contact area which is large relative to the diameter of the shaft, pivotably mounted on the upper end of said upper shaft portion;

F. A second non-skid pad, said pad having a generally rectangular shape and having a flat surface contact area which is large relative to the diameter of the shaft, pivotably mounted on the lower end of said lower shaft portion;

G. An alarm device fixedly mounted to said middle shaft portion;

H. Actuating means, mounted on said upper shaft portion, providing means for actuating the alarm, said actuating means being responsive to a limited movement of the door inwardly.

8. The device of claim 7 wherein said adjusting means comprise:

A. The slidable combination of the lower shaft portion and the middle shaft portion and;

B. Plunger means adjustably registerable with one of a plurality of holes longitudinally arranged in said lower and middle shaft portions.

9. The device of claim 8 further comprising:

A. Coil spring means slidably disposed inside of the upper shaft portion;

B. Pin means displaced through the middle shaft portion such that the coil spring means contact said pin means and are restrained and compressed when the upper shaft portion is engaged with the middle shaft portion;

C. Channel means provided in said upper shaft portion;

D. Pin means placed through the middle shaft portion and the channel means of the upper shaft portion, such that said pin means restrain said upper shaft portion in its postion relative to the middle shaft portion when said coil spring means are compressed, while said channel means simultaneously allow said upper shaft portion to move in a limited longitudinal range with respect to the middle shaft portion.

10. The device of claim 9 wherein said channel means comprise a slot formed in the wall of said upper shaft portion.

* * * * *